US005791948A

United States Patent [19]

LeCompte

[11] Patent Number: 5,791,948

[45] Date of Patent: Aug. 11, 1998

[54] OUTBOARD AIR DRIVE SYSTEM

[76] Inventor: Dale LeCompte, 412 Gaynell Dr., Houma, La. 70364

[21] Appl. No.: 888,181

[22] Filed: Jul. 3, 1997

[51] Int. Cl.[6] ..... B63H 7/00

[52] U.S. Cl. ..... 440/37; 440/87

[58] Field of Search ..... 440/84, 87, 37; 248/637, 640, 674

[56] References Cited

U.S. PATENT DOCUMENTS

| | | | |
|---|---|---|---|
| 2,914,013 | 11/1959 | Bizjak | 440/37 |
| 2,948,250 | 8/1960 | Peterson | 440/37 |
| 2,987,281 | 6/1961 | Schurr et al. | 440/37 |
| 3,500,784 | 3/1970 | Reynolds | 440/37 |
| 3,613,632 | 10/1971 | Farrell | 440/87 |
| 3,786,892 | 1/1974 | Horton | 440/84 |
| 4,005,673 | 2/1977 | Carrero | 440/37 |
| 4,015,555 | 4/1977 | Tinkham | 440/37 |
| 4,175,630 | 11/1979 | Fleisher et al. | 180/225 |
| 4,418,784 | 12/1983 | Fox | 180/221 |
| 4,539,452 | 9/1985 | Draxler et al. | 440/84 |
| 4,650,429 | 3/1987 | Boda | 440/87 |
| 4,932,839 | 6/1990 | Pitchford | 440/37 |
| 4,962,717 | 10/1990 | Tsumiyama | 440/87 |
| 5,423,393 | 6/1995 | Felt | 18/22 |
| 5,494,128 | 2/1996 | Witthaus | 180/221 |

*Primary Examiner*—Sherman Basinger
*Attorney, Agent, or Firm*—Joseph N. Breaux

[57] ABSTRACT

An outboard drive system that includes a drive assembly and a drive system control assembly. The drive assembly includes a base assembly; a fan propulsion assembly including a internal combustion drive motor, a propeller, and a coupling shaft; a safety cage; a dual rudder assembly; a kill switch wire in electrical connection with the drive motor; a throttle positioning cable assembly; and a rudder positioning cable assembly; the drive system control assembly including a housing structure; a mounting plate; a rudder positioning cable control stick; a manual kill switch button; and a spring loaded throttle cable control trigger.

16 Claims, 4 Drawing Sheets

OUTBOARD AIR DRIVE SYSTEM

TECHNICAL FIELD

The present invention relates to drive systems for vehicles and more particularly to an air drive system attachable to a vehicle such as a cart, cycle or watercraft that includes a drive assembly and a drive system control assembly; the drive assembly including a base assembly having a vehicle attachment clamp; a fan propulsion assembly including a internal combustion drive motor secured to the base assembly, a propeller, and a coupling shaft coupling the output of the drive motor to the propeller; a safety cage secured to the base assembly and surrounding the propeller; a dual rudder assembly including two coupled and moveable rudders mounted on a rudder attachment plate of the base assembly and pivotal in a manner to direct air driven by the propeller in a desired direction; a kill switch wire in electrical connection with the spark plug cable of the drive motor; a throttle positioning cable assembly including a moveable throttle cable, the moveable throttle cable being attached to a throttle control arm of the drive motor; and a rudder positioning cable assembly including a moveable rudder cable, the moveable rudder cable being attached to a rudder steering rod of the dual rudder assembly; the drive system control assembly including a housing structure; a mounting plate extending from the housing; a rudder positioning cable control stick pivotally connected to the housing structure, the rudder positioning cable control stick having a moveable control stick end attached to the moveable rudder cable in a manner such that movement of the moveable control stick end results in movement of both of the rudders of the dual rudder assembly; a manual kill switch button in electrical connection with the kill switch line; a detachable kill switch key switch in electrical connection with the kill switch line, the manual kill switch button and the detachable kill switch key switch being wired in parallel between the kill switch line and electrical engine ground; and a spring loaded throttle cable control trigger mounted on the rudder positioning cable control stick and in connection with the moveable throttle cable attached to the throttle control arm of the drive motor in a manner such that movement of the throttle cable control trigger causes a movement of the throttle control arm of the drive motor.

BACKGROUND OF THE INVENTION

It is often desirable to add a drive system to an unpowered vehicle such as a cart or watercraft. In addition, in many cases it is often desirable to add an additional drive system to provide an alternative drive mode for a vehicle such as a watercraft where it may be advantageous to have more than one type of propulsion system. It would be a benefit, therefore, to have an outboard air drive system that is installable on a vehicle to provide an air drive capability to the vehicle. It would also be a benefit to have an outboard air drive system that included a base assembly that was easily manufactured and easily mounted on a vehicle. In addition, it would also be a benefit to have an outboard air drive system that utilized a readily available two stroke internal combustion engine such as is used on small lawn equipment devices such as weed trimmers in order to minimize manufacturing and maintenance costs.

SUMMARY OF THE INVENTION

It is thus an object of the invention to provide an outboard air drive system that is installable on a vehicle to provide an air drive capability to the vehicle.

It is a further object of the invention to provide an outboard air drive system that includes a base assembly that is easily manufactured.

It is a further object of the invention to provide an outboard air drive system that includes a base assembly that is easily mounted on a vehicle.

It is a still further object of the invention to provide an outboard air drive system that utilizes a readily available two stroke internal combustion engine as a drive motor.

It is a still further object of the invention to provide an outboard air drive system that includes a drive assembly and a drive system control assembly; the drive assembly including a base assembly having a vehicle attachment clamp; a fan propulsion assembly including a internal combustion drive motor secured to the base assembly, a propeller, and a coupling shaft coupling the output of the drive motor to the propeller; a safety cage secured to the base assembly and surrounding the propeller; a dual rudder assembly including two coupled and moveable rudders mounted on a rudder attachment plate of the base assembly and pivotal in a manner to direct air driven by the propeller in a desired direction; a kill switch wire in electrical connection with the spark plug cable of the drive motor; a throttle positioning cable assembly including a moveable throttle cable, the moveable throttle cable being attached to a throttle control arm of the drive motor; and a rudder positioning cable assembly including a moveable rudder cable, the moveable rudder cable being attached to a rudder steering rod of the dual rudder assembly; the drive system control assembly including a housing structure; a mounting plate extending from the housing; a rudder positioning cable control stick pivotally connected to the housing structure, the rudder positioning cable control stick having a moveable control stick end attached to the moveable rudder cable in a manner such that movement of the moveable control stick end results in movement of both of the rudders of the dual rudder assembly; a manual kill switch button in electrical connection with the kill switch line; a detachable kill switch key switch in electrical connection with the kill switch line, the manual kill switch button and the detachable kill switch key switch being wired in parallel between the kill switch line and electrical engine ground; and a spring loaded throttle cable control trigger mounted on the rudder positioning cable control stick and in connection with the moveable throttle cable attached to the throttle control arm of the drive motor in a manner such that movement of the throttle cable control trigger causes a movement of the throttle control arm of the drive motor.

It is a still further object of the invention to provide an outboard air drive system that accomplishes some or all of the above objects in combination.

Accordingly, an outboard drive system is provided that includes a drive assembly and a drive system control assembly; the drive assembly including a base assembly having a vehicle attachment clamp; a fan propulsion assembly including a internal combustion drive motor secured to the base assembly, a propeller, and a coupling shaft coupling the output of the drive motor to the propeller; a safety cage secured to the base assembly and surrounding the propeller; a dual rudder assembly including two coupled and moveable rudders mounted on a rudder attachment plate of the base assembly and pivotal in a manner to direct air driven by the propeller in a desired direction; a kill switch wire in electrical connection with the spark plug cable of the drive motor; a throttle positioning cable assembly including a moveable throttle cable, the moveable throttle cable being attached to a throttle control arm of the drive motor; and a rudder positioning cable assembly including a moveable rudder cable, the moveable rudder cable being attached to a rudder steering rod of the dual rudder assembly; the drive system control assembly including a housing structure; a mounting plate extending from the housing; a rudder positioning cable control stick pivotally connected to the housing structure, the rudder positioning cable control stick having a moveable control stick end attached to the moveable rudder cable in a manner such that movement of the moveable control stick end results in movement of both of the rudders of the dual rudder assembly; a manual kill switch button in electrical connection with the kill switch line; a detachable kill switch key switch in electrical connection with the kill switch line, the manual kill switch button and the detachable kill switch key switch being wired in parallel between the kill switch line and electrical engine ground; and a spring loaded throttle cable control trigger mounted on the rudder positioning cable control stick and in connection with the moveable throttle cable attached to the throttle control arm of the drive motor in a manner such that movement of the throttle cable control trigger causes a movement of the throttle control arm of the drive motor.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
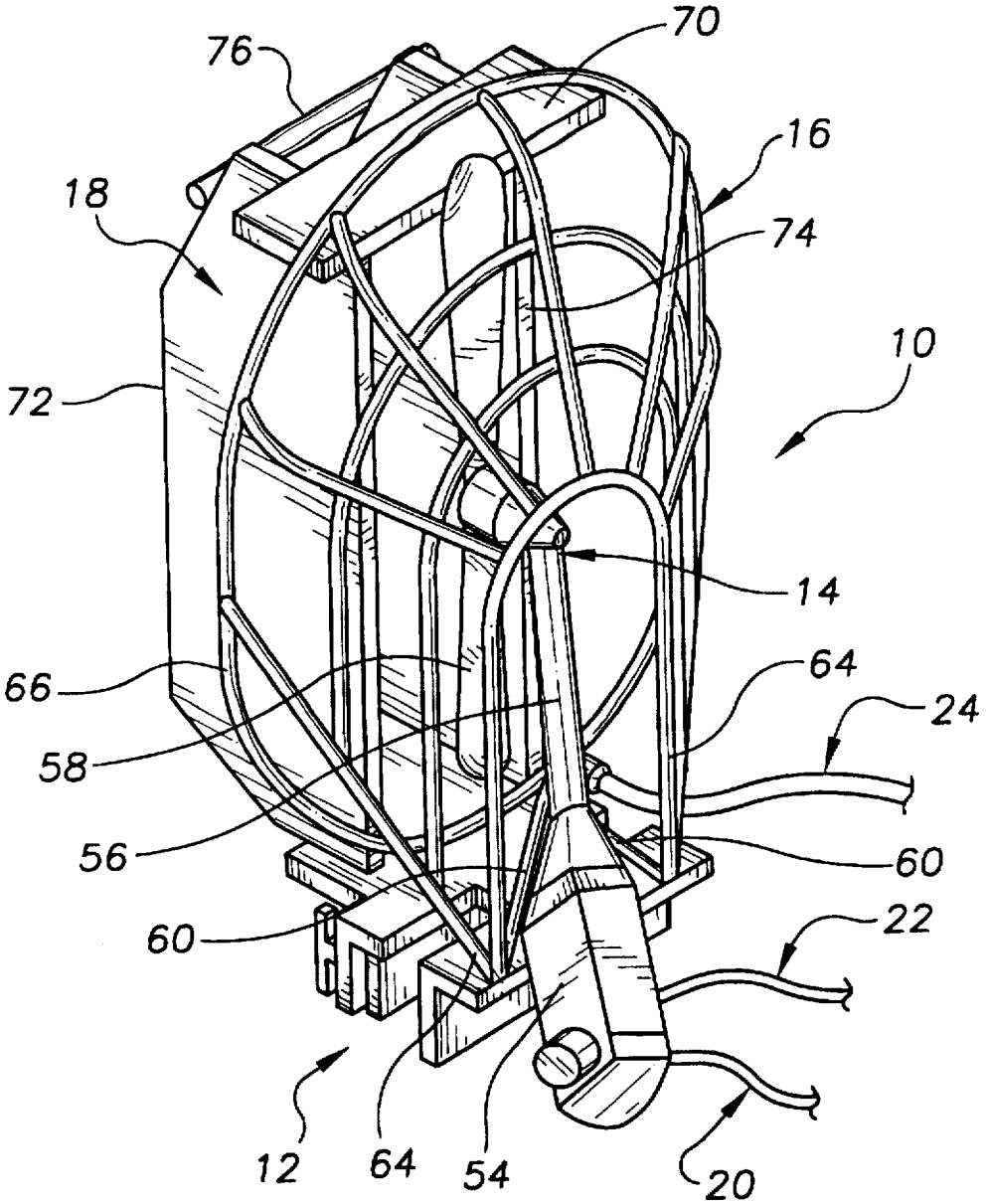
FIG. 1 is a perspective view of an exemplary embodiment of the drive assembly of the outboard air drive system of the present invention showing the base assembly including the vehicle clamp; the fan assembly including the motor, the coupling shaft and the propeller; the safety cage; the dual rudder assembly; the kill switch line; the throttle positioning cable assembly; and the rudder positioning cable assembly.

FIG. 1 shows an exemplary embodiment of the drive assembly of the outboard air drive system of the present invention generally designated by the numeral 10. In this embodiment, drive assembly 10 includes a base assembly, generally designated 12; a fan assembly, generally designated 14; a safety cage, generally designated 16; a dual rudder assembly, generally designated 18; a kill switch line, generally designated 20; a throttle positioning cable assembly, generally designated 22; and a rudder positioning cable assembly, generally designated 24.

Figure 2:
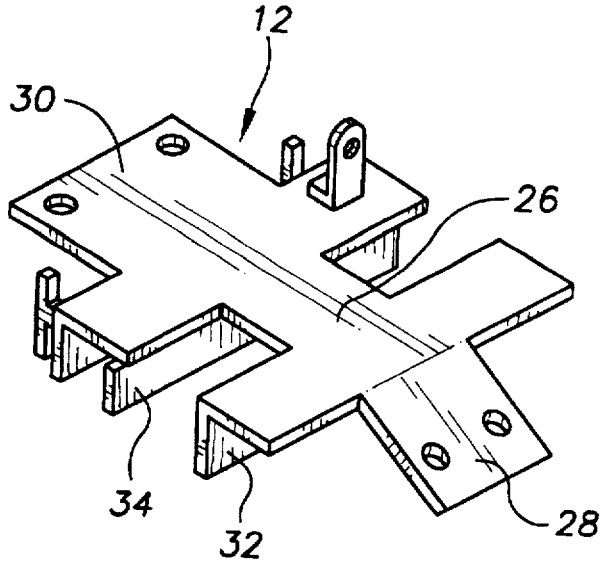
FIG. 2 is a top perspective view of the base assembly of FIG. 1 in isolation showing the centrally positioned H-shaped cage support plate, the angularly oriented drive motor support plate, the rectangular shaped rudder support plate, one of the two front clamping plates, the moveable rear clamping plate, the two T-handle rear clamping plate positioning screws, and the rudder cable mounting bracket.
Figure 3:
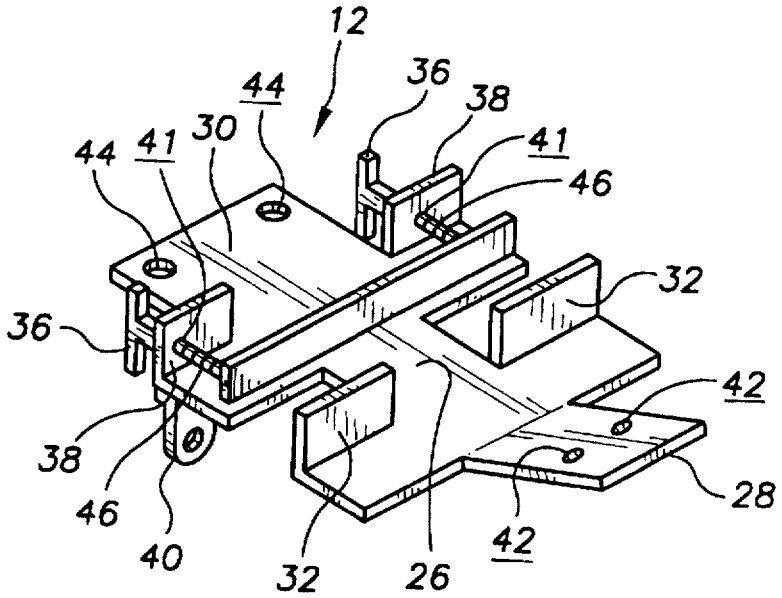
FIG. 3 is an underside perspective view of the base assembly of FIG. 1 in isolation showing the centrally positioned H-shaped cage support plate, the angularly oriented drive motor support plate, the rectangular shaped rudder support plate, the two front clamping plates, the moveable rear clamping plate, the two T-handle rear clamping plate positioning screws, the two positioning screw support plates, and the rudder cable mounting bracket.

With reference to FIG. 2, base assembly 12 is of steel construction and includes centrally positioned H-shaped cage support plate 26, an angularly oriented drive motor support plate 28, a rectangular shaped rudder support plate 30, two front clamping plates 32 (see FIG. 3), a moveable rear clamping plate 34, with reference now to FIG. 3, two T-handle rear clamping plate positioning screws 36, two positioning screw support plates 38, and an L-shaped rudder cable mounting bracket 40. In this embodiment, H-shaped cage support plate 26, drive motor support plate 28, rudder support plate 30, the two front clamping plates 32, and the two positioning screw support plates 38 are stamped from a single section of steel sheeting. Drive motor support plate 28 has a pair of drive motor mounting apertures 42. Rudder support plate 30 has two rudder shaft apertures 44.

Figure 4:
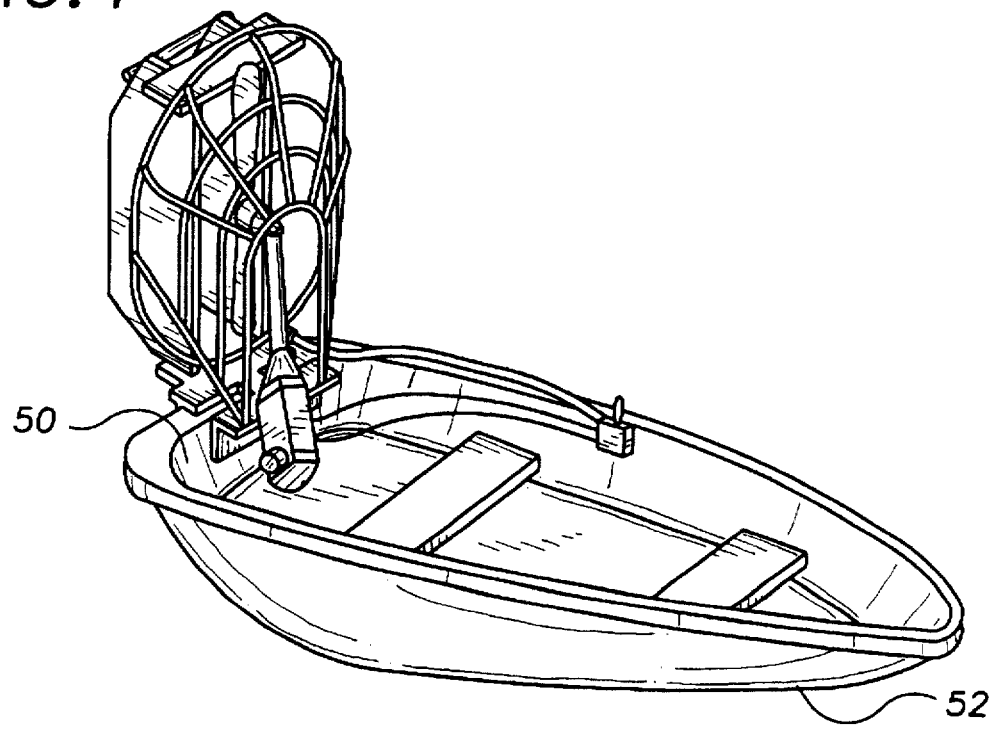
FIG. 4 is a perspective view showing the exemplary drive assembly of the outboard air drive system of the present invention clamped to the transom of representative boat and the kill switch line, the throttle positioning cable assembly and the rudder positioning cable assembly connected to the drive system control assembly.

Positioning screw support plates 38 each include a threaded positioning screw aperture 41. Each of the T-handle rear clamping plate positioning screws 36 has a threaded shaft 46 that is threaded through a threaded positioning screw aperture 41. The end of each threaded shaft 46 is rotatably coupled to moveable rear clamping plate 34. In use base assembly 12 is secured to a portion of a vehicle, referring to FIG. 4, such as the transom 50 of boat 52, referring back to FIG. 3, by placing the portion of the vehicle between the two front clamping plates 32 and moveable rear clamping plate 34 and then tightening the two T-handle rear clamping plate positioning screws 36 until the vehicle portion is firmly held between the two front clamping plates 32 and moveable rear clamping plate 34.

With reference back to FIG. 1, fan assembly 14 includes a conventional sixty CC, two-stroke, internal combustion motor 54, a propeller 58 and a coupling shaft 56 coupled between the output of internal combustion motor 54 and propeller 58. In this embodiment, internal combustion motor 54 and coupling shaft 56 are from a conventional lawn and garden weed trimmer. Of course, other types of internal combustion motors 54 and coupling shafts 56 can be used without departing from the scope and spirit of the invention taught herein. Internal combustion motor 54 is bolted to drive motor support plate 28 (FIGS. 2,3). Coupling shaft 56 is supported by two angled steel shaft supports 60 that are welded between coupling shaft 56 and H-shaped cage support plate 26 (FIG. 2).

Safety cage 16 is constructed from steel wire that has been shaped and welded together to form a dish shaped cage having two V-shaped forward supports 64 that are welded to a forward portion of H-shaped cage support plate 26 (FIG. 2) and a ring shaped rear support 66 that is welded to a rearward portion of H-shaped cage support plate 26 (FIG. 2). Safety cage 16 is sized to allow propeller 58 to rotate completely within safety cage 16.

Dual rudder assembly 18 includes two stamped aluminum rudders 72,74 that are pivotally mounted between rectangular shaped rudder support plate 30 (FIG. 2) of base assembly 12 and a top rudder mounting plate 70 that is welded to safety cage 16. Stamped aluminum rudders 72,74 are ganged together by a connecting bar 76 in a manner such that movement of either rudder 72,74 results in a corresponding movement of the other rudder 72,74.

Figure 5:
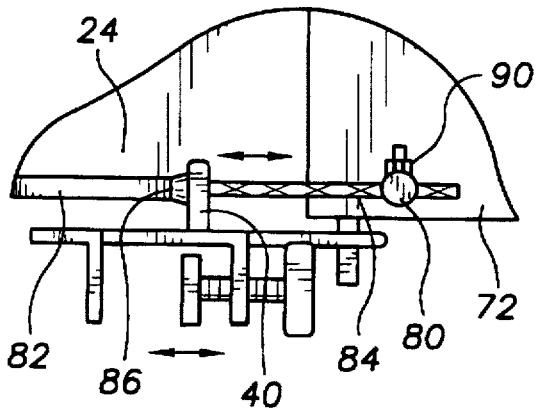
FIG. 5 is a detail side perspective view of the drive assembly of FIG. 1 showing the rudder cable sheath of the rudder positioning cable assembly secured to the rudder cable mounting bracket, the rudder positioning cable extending out through the opening of the rudder cable mounting bracket and secured to the rudder assembly steering rod, one of the two front clamping plates, the moveable rear clamping plate, one of the two T-handle rear clamping plate positioning screws, and one of the two rudders of the dual rudder assembly.
Figure 6:
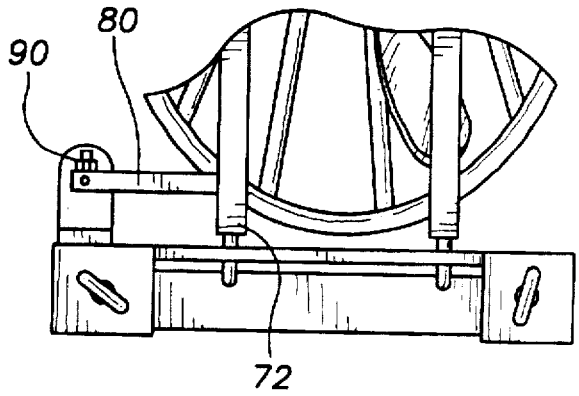
FIG. 6 is a rear end partial plan view the drive assembly of FIG. 1 showing the rudder positioning cable secured to the rudder assembly steering rod, the moveable rear clamping plate extending between the two positioning screw support plates, the two T-handle rear clamping plate positioning screws, and the two rudders of the dual rudder assembly, each rudder having one end of its rudder shaft rotatably entrapped by and positioned through one of the two rudder shaft apertures of the rectangular shaped rudder support plate.

With reference to FIG. 5, rudder 72 has a rudder assembly steering rod 80 that, with reference to FIG. 6, extends perpendicularly from the side surface of rudder 72. With reference back to FIG. 5, rudder positioning cable assembly 24 includes a tubular rudder cable sheath 82 through which a moveable steel rudder positioning cable 84 is positioned. A first end 86 of rudder cable positioning sheath 82 is secured to rudder cable mounting bracket 40. Steel rudder positioning cable 84 is positioned through rudder cable mounting bracket 40 and is secured to the end 88 (FIG. 6) of rudder assembly steering rod 80 with a securing nut 90.

Figure 7:
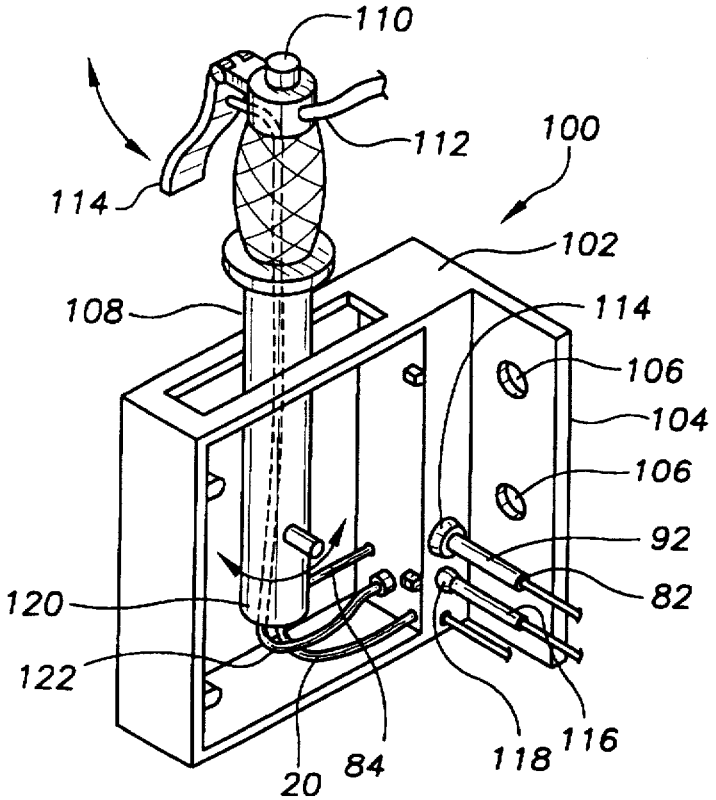
FIG. 7 is a perspective view of an exemplary embodiment of the drive system control assembly of the outboard air drive system of the present invention showing the housing with a rectangular shaped side cover plate removed, the mounting plate, the manual kill switch button, the detachable kill switch key, the spring loaded throttle cable control trigger, and the rudder positioning cable control stick.

FIG. 7 shows an exemplary embodiment of the drive system control assembly of the outboard air drive system of the present invention generally designated by the numeral 100. In this embodiment, control assembly 100 includes a rectangular steel housing 102, a steel mounting plate 104 having two mounting apertures 106, a tubular pivoting rudder positioning cable control stick 108, a manual kill switch button 110, a detachable kill switch key 112, and a spring loaded throttle cable control trigger 114. A second end 92 of rudder cable positioning sheath 82 is secured to a rudder cable positioning sheath housing fitting 114 provided on the exterior of housing 102. Steel rudder positioning cable 84 is threaded through a rudder cable passageway formed through housing 102 and is secured to the end 120 of pivoting rudder positioning cable control stick 108.

A throttle cable sheath 116 is secured to housing 102 by a throttle cable sheath fitting 118. A moveable throttle positioning cable 122 is threaded through a throttle cable passageway, through tubular rudder positioning cable control stick 108 and secured to spring loaded throttle cable control trigger 114.

Figure 8:
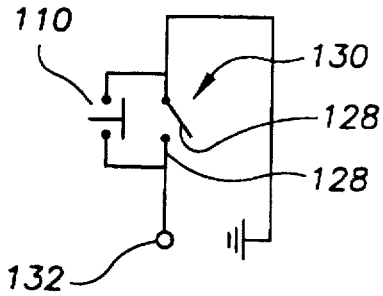
FIG. 8 is a schematic electrical diagram showing the kill switch circuit showing the manual kill switch button and the detachable kill switch key wired in parallel between the spark plug cable of the motor and electrical engine ground.

In this embodiment, manual kill switch button 110 and a detachable kill switch key 112 are mounted to the top end of tubular rudder positioning cable control stick 108. With reference to FIG. 8, manual kill switch button 110 is a momentary contact normally open push button type switch. Detachable kill switch key 112 is constructed from plastic and is inserted between the electrical contacts 128 of a spring biased normally closed switch 130. In use, detachable kill switch key 112 is inserted between and separates the electrical contacts 128 causing spring biased normally closed switch 130 to remain in the open state. Removal of detachable kill switch key 112 results the closing of electrical contacts 128 and the grounding of the spark plug cable 132 of internal combustion motor 54. Similarly depressing manual kill switch button 110 also results in the grounding of the spark plug cable of internal combustion motor 54 through kill line 20 (FIGS. 1,7, and 8).

It can be seen from the preceding description that an outboard air drive system has been provided that is installable on a vehicle to provide an air drive capability to the vehicle; that includes a base assembly that is easily manufactured; that includes a base assembly that is easily mounted on a vehicle; that utilizes a readily available two stroke internal combustion engine as a drive motor; and that includes a drive assembly and a drive system control assembly; the drive assembly including a base assembly having a vehicle attachment clamp; a fan propulsion assembly including a internal combustion drive motor secured to the base assembly, a propeller, and a coupling shaft coupling the output of the drive motor to the propeller; a safety cage secured to the base assembly and surrounding the propeller; a dual rudder assembly including two coupled and moveable rudders mounted on a rudder attachment plate of the base assembly and pivotal in a manner to direct air driven by the propeller in a desired direction; a kill switch wire in electrical connection with the spark plug cable of the drive motor; a throttle positioning cable assembly including a moveable throttle cable, the moveable throttle cable being attached to a throttle control arm of the drive motor; and a rudder positioning cable assembly including a moveable rudder cable, the moveable rudder cable being attached to a rudder steering rod of the dual rudder assembly; the drive system control assembly including a housing structure; a mounting plate extending from the housing; a rudder positioning cable control stick pivotally connected to the housing structure, the rudder positioning cable control stick having a moveable control stick end attached to the moveable rudder cable in a manner such that movement of the moveable control stick end results in movement of both of the rudders of the dual rudder assembly; a manual kill switch button in electrical connection with the kill switch line; a detachable kill switch key switch in electrical connection with the kill switch line, the manual kill switch button and the detachable kill switch key switch being wired in parallel between the kill switch line and electrical engine ground; and a spring loaded throttle cable control trigger mounted on the rudder positioning cable control stick and in connection with the moveable throttle cable attached to the throttle control arm of the drive motor in a manner such that movement of the throttle cable control trigger causes a movement of the throttle control arm of the drive motor.

It is noted that the embodiment of the outboard air drive system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An outboard air drive system comprising:

a drive assembly; and a drive system control assembly;

said drive assembly including:

a base assembly having a vehicle attachment clamp;

a fan propulsion assembly including a internal combustion drive motor secured to said base assembly, a propeller, and a coupling shaft coupling said output of said drive motor to said propeller;

a safety cage secured to said base assembly and surrounding said propeller;

a dual rudder assembly including two coupled and moveable rudders mounted on a rudder attachment plate of said base assembly and pivotal in a manner to direct air driven by said propeller in a desired direction;

a kill switch line in electrical connection with said spark plug cable of said drive motor;

a throttle positioning cable assembly including a moveable throttle cable, said moveable throttle cable being attached to a throttle control arm of said drive motor; and a rudder positioning cable assembly including a moveable rudder cable, said moveable rudder cable being attached to a rudder steering rod of said dual rudder assembly;

said drive system control assembly including:

a housing structure; a mounting plate extending from said housing;

a rudder positioning cable control stick pivotally connected to said housing structure, said rudder positioning cable control stick having a moveable control stick end attached to said moveable rudder cable in a manner such that movement of said moveable control stick end results in movement of both of said rudders of said dual rudder assembly;

a manual kill switch button in electrical connection with said kill switch line;

a detachable kill switch key switch in electrical connection with said kill switch line, said manual kill switch button and said detachable kill switch key switch being wired in parallel between said kill switch line and electrical engine ground; and a spring loaded throttle cable control trigger mounted on said rudder positioning cable control stick and in connection with said moveable throttle cable attached to said throttle control arm of said drive motor in a manner such that movement of said throttle cable control trigger causes a movement of said throttle control arm of said drive motor.

2. The outboard air drive system of claim 1, wherein:

said base assembly includes an angularly oriented drive motor support plate.

3. The outboard air drive system of claim 2, wherein:

said base assembly includes a rectangular shaped rudder support plate.

4. The outboard air drive system of claim 3 wherein:

said base assembly includes two front clamping plates and a moveable rear clamping plate.

5. The outboard air drive system of claim 4 wherein:

said base assembly includes two rear clamping plate positioning screws rotatably coupled to said moveable rear clamping plate.

6. The outboard air drive system of claim 3 wherein:

said base assembly includes a moveable rear clamping plate, and two rear clamping plate positioning screws rotatably coupled to said moveable rear clamping plate.

7. The outboard air drive system of claim 2 wherein:

said base assembly includes two front clamping plates and a moveable rear clamping plate.

8. The outboard air drive system of claim 2 wherein:

said base assembly includes a moveable rear clamping plate, and two rear clamping plate positioning screws rotatably coupled to said moveable rear clamping plate.

9. The outboard air drive system of claim 1, wherein:

said base assembly includes a rectangular shaped rudder support plate.

10. The outboard air drive system of claim 9 wherein:

said base assembly includes two front clamping plates and a moveable rear clamping plate.

11. The outboard air drive system of claim 10 wherein:

said base assembly includes two rear clamping plate positioning screws rotatably coupled to said moveable rear clamping plate.

12. The outboard air drive system of claim 9 wherein:

said base assembly includes a moveable rear clamping plate, and two rear clamping plate positioning screws rotatably coupled to said moveable rear clamping plate.

13. The outboard air drive system of claim 1 wherein:

said base assembly includes two front clamping plates and a moveable rear clamping plate.

14. The outboard air drive system of claim 13 wherein:

said base assembly includes two rear clamping plate positioning screws rotatably coupled to said moveable rear clamping plate.

15. The outboard air drive system of claim 1 wherein:

said base assembly includes a moveable rear clamping plate, and two rear clamping plate positioning screws rotatably coupled to said moveable rear clamping plate.

16. The outboard air drive system of claim 1 wherein:

said base assembly includes:

a centrally positioned H-shaped cage support plate;

a drive motor support plate angularly oriented with respect to said H-shaped cage support plate;

a rectangular shaped rudder support plate extending from a side edge of said H-shaped cage support plate; and two front clamping plates depending from the H-shaped cage support plate.

* * * * *